US010263319B2

(12) United States Patent
Hung et al.

(10) Patent No.: US 10,263,319 B2
(45) Date of Patent: Apr. 16, 2019

(54) ANTENNA WITH SWAPPABLE RADIATION DIRECTION AND COMMUNICATION DEVICE THEREOF

(71) Applicant: MEDIATEK INC., Hsin-Chu (TW)

(72) Inventors: Chung-Yu Hung, Taipei (TW); Chen-Fang Tai, New Taipei (TW); Wun-Jian Lin, Kaohsiung (TW); Shih-Huang Yeh, Hsinchu (TW)

(73) Assignee: MEDIATEK INC., Hsin-Chu (TW)

( * ) Notice: Subject to any disclaimer, the term of this patent is extended or adjusted under 35 U.S.C. 154(b) by 120 days.

(21) Appl. No.: 15/394,713

(22) Filed: Dec. 29, 2016

(65) Prior Publication Data

US 2017/0279185 A1 Sep. 28, 2017

Related U.S. Application Data

(60) Provisional application No. 62/311,951, filed on Mar. 23, 2016.

(51) Int. Cl.

| | |
|---|---|
| ***H01Q 3/24*** | (2006.01) |
| ***H01Q 9/04*** | (2006.01) |
| ***H01Q 1/24*** | (2006.01) |
| ***H01Q 1/22*** | (2006.01) |
| ***H01Q 7/00*** | (2006.01) |
| ***H01Q 21/29*** | (2006.01) |
| ***H01Q 5/328*** | (2015.01) |

(52) U.S. Cl.

CPC ..... *H01Q 1/245* (2013.01); *H01Q 1/2266* (2013.01); *H01Q 1/243* (2013.01); *H01Q 3/24* (2013.01); *H01Q 5/328* (2015.01); *H01Q 7/00* (2013.01); *H01Q 7/005* (2013.01); *H01Q 9/04* (2013.01); *H01Q 9/0442* (2013.01); *H01Q 21/29* (2013.01)

(58) Field of Classification Search

CPC ..... H01Q 1/2266; H01Q 1/245; H01Q 3/24; H01Q 7/00; H01Q 9/04; H01Q 9/0442; H01Q 1/243; H01Q 21/29; H01Q 5/328; H01Q 7/005

See application file for complete search history.

(56) References Cited

U.S. PATENT DOCUMENTS 6,980,154 B2 * 12/2005 Vance ..... H01Q 1/243 343/700 MS
7,916,089 B2 * 3/2011 Schlub ..... H01Q 1/243 343/702

(Continued)

FOREIGN PATENT DOCUMENTS

TW 201338272 A 9/2013
TW 201541713 A 11/2015

*Primary Examiner* — Tho G Phan
(74) *Attorney, Agent, or Firm* — Winston Hsu

(57) ABSTRACT

An antenna with swappable and selective radiation direction includes a first arm, a second arm electrically connected to the first arm, a third arm is electrically connected to the first arm, a first impedance tuning circuit coupled to the second arm for connecting the second arm to a ground or a first matching component according to a control signal, and a second impedance tuning circuit coupled to the third arm for connecting the third arm to the ground or a second matching component according to the control signal. By tuning impedance of the antenna, the antenna operates in a first mode corresponding to a first radiation direction or a second mode corresponding to a second radiation direction.

4 Claims, 8 Drawing Sheets

Mode 1

(56) References Cited

U.S. PATENT DOCUMENTS

| | | | | |
|---|---|---|---|---|
| 9,166,279 | B2 * | 10/2015 | Jin | H01Q 1/243 |
| 9,276,320 | B2 * | 3/2016 | Wu | H01Q 1/243 |
| 9,350,069 | B2 * | 5/2016 | Pascolini | H01Q 5/357 |
| 9,472,848 | B2 * | 10/2016 | Pajona | H01Q 7/00 |

* cited by examiner

ANTENNA WITH SWAPPABLE RADIATION DIRECTION AND COMMUNICATION DEVICE THEREOF

CROSS REFERENCE TO RELATED APPLICATIONS

This application claims the benefit of U.S. Provisional Application No. 62/311,951, filed on Mar. 23, 2016, the contents of which are incorporated herein.

BACKGROUND

A wireless communication device, such as a mobile phone, a tablet computer, a laptop computer and so on, exchanges radio-frequency signals through an antenna to access information within a wireless communication system. A radio-frequency (RF) signal is a sinusoidal wave with a high oscillating frequency, and governments in the world have defined safety limits, e.g. by electromagnetic standards, for exposure to RF energy produced from wireless communication devices, which mainly exposes to human head or limb.

The electromagnetic standards as to the RF energy exposure are based on specific absorption rate (SAR). SAR is a measure of the rate at which energy is absorbed by a human body when exposed to an RF electromagnetic field.

Due to a trend of light and compact wireless communication device and growing wireless communication demands, an ideal antenna inside the wireless communication device is expected to be small, antenna gain thereof is expected to be high and radiating bandwidth thereof is expected to be as wider as possible. However, a greater antenna gain results in a worse SAR value. Also, RF energy with high frequencies is easily to be absorbed in near field, which leads to the worse SAR value.

On the other hand, the antenna performance of the mobile phone could degrade because of effects of human body and user scenario, such as the methods/position of hand holding the mobile device or the antenna being too close to human body, and could degrade the quality of communication, e.g., causing low data throughput or high call-drop rate.

Therefore, how to solve the tradeoff between SAR and antenna performance has become a goal in the wireless communication industry.

SUMMARY

It is therefore an objective of the present invention to provide an antenna with swappable and selective radiation direction and communication device thereof.

The present invention discloses an antenna with swappable and selective radiation direction. The antenna includes a feed terminal, a first arm, a second arm, a third arm, a first impedance tuning circuit, and a second impedance tuning circuit. The feed terminal is used for feeding a transmit signal and receiving a receive signal. The first arm is electrically connected to the feed terminal, the second arm is electrically connected to the first arm, and the third arm is electrically connected to the first arm, wherein the feed terminal forms loops each with the second arm and third arm. The first impedance tuning circuit is coupled to the second arm for connecting the second arm to first and third matching components according to a control signal. The second impedance tuning circuit is coupled to the third arm for connecting the third arm to the second or fourth matching components according to the control signal. When the antenna operates in a first mode, the first impedance tuning circuit connects the second arm to the first matching component and the second impedance tuning circuit connects the third arm to the second matching component, and when the antenna operates in a second mode, the first impedance tuning circuit connects the second arm to the third matching component and the second impedance tuning circuit connects the third arm to the fourth matching component.

The present invention further discloses a communication device including a first antenna and a second antenna. The present invention selects the radiation direction of a first antenna by impedance tuning of the first antenna to respectively operate in two operating modes, and the band tuning to the first antenna is simultaneously performed. The first antenna has two operating modes without additional antennas to the communication device, which effectively save the antenna space of the communication device. Further, selecting the radiation direction of the first antenna by impedance tuning and a feeding channel of the transmit signal to either the first or second antenna of the communication device, the communication device can adapt to various user scenarios to ensure communication quality and user experience (e.g., data throughput and call-drop rate).

These and other objectives of the present invention will no doubt become obvious to those of ordinary skill in the art after reading the following detailed description of the preferred embodiment that is illustrated in the various figures and drawings.

DETAILED DESCRIPTION

Figure 1:
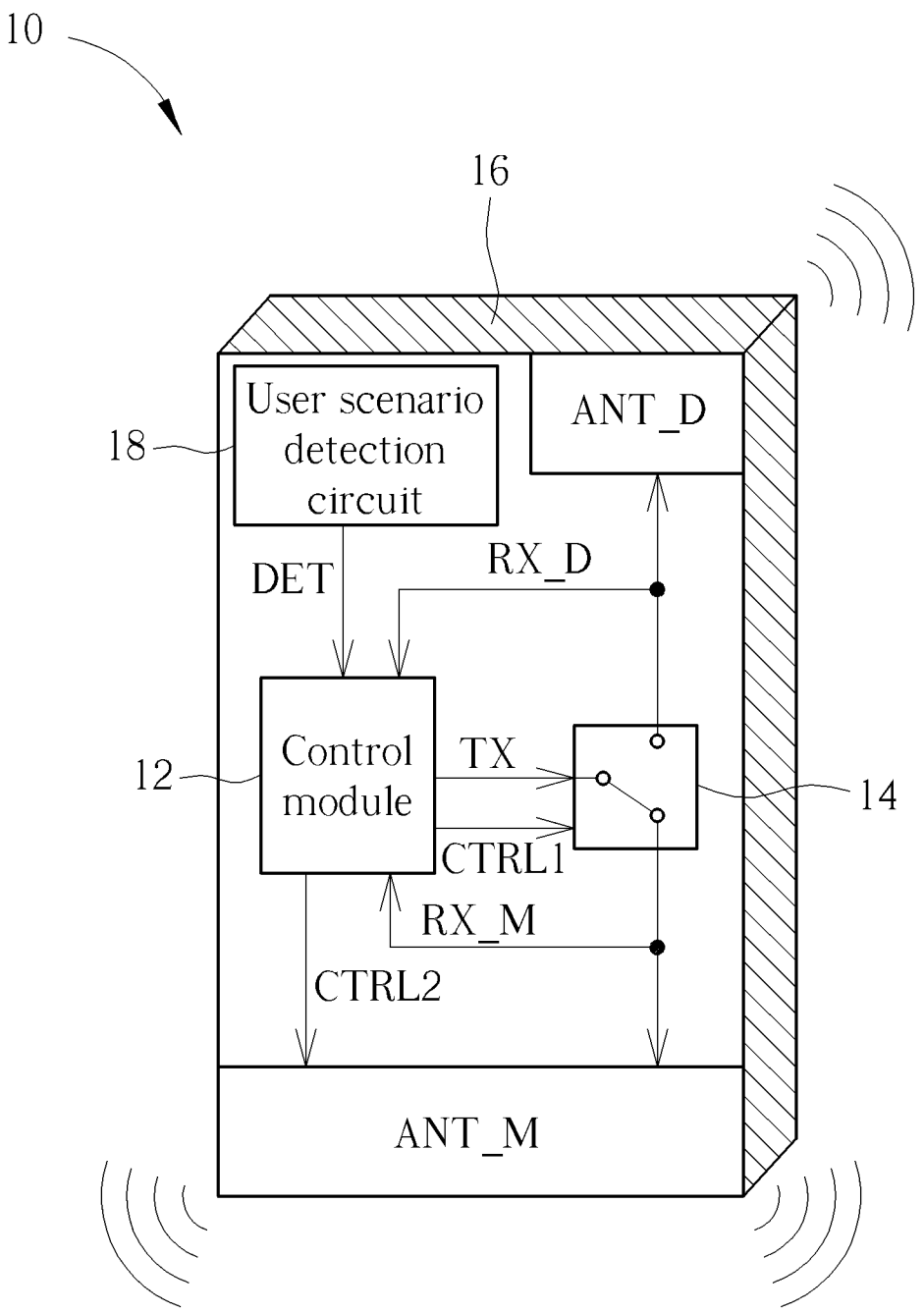
FIG. 1 is a schematic diagram of a wireless communication device according to an embodiment of the present invention.

FIG. 1 is a schematic diagram of a wireless communication device 10 according to an embodiment of the present invention. The wireless communication device 10 includes antennas ANT_M and ANT_D, a control module 12, a switch circuit 14, and a back cover 16.

The control module 12 is coupled to the antennas ANT_M and ANT_D for generating a transmitting signal TX and a control signal CTRL1 to the switch circuit 14 according to receiving signals RX_M and RX_D respectively received by the antennas ANT_M and ANT_D. The control module 12 further generates a control signal CTRL2 to the antenna ANT_M for selecting a radiation direction of the antenna ANT_M by impedance tuning according to the receiving signals RX_M and RX_D. The switch circuit 14 is coupled to the antennas ANT_M and ANT_D and the control module 12 for switching either the antenna ANT_M or the antenna ANT_D to be fed with the transmitting signal TX according to the control signal CTRL1. The antenna ANT_M is coupled to the control module 12 and the switch circuit 14 for receiving the receiving signal RX_M from the air, and transmitting the transmitting signal TX if it is fed with the transmitting signal TX. The antenna ANT_D is coupled to the control module 12 and the switch circuit 14 for receiving the receiving signal RX_D from the air, and transmitting the transmitting signal TX if it is fed with the transmitting signal TX. The back cover 16 contains the antennas ANT_M and ANT_D, the control module 12, the switch circuit 14 and any possible electric circuit boards and mechanical parts of the communication device 10, and the back cover 16 may be made of metal or plastic materials.

In one embodiment, the control module 12 generates the control signals CTRL1 and CTRL2 according to a detection signal DET, wherein the detection signal DET may be generated by a user scenario detection circuit, which may be a proximity sensing circuit for detecting proximity of an object, or a G-sensor for detecting gravity direction relative to the communication device 10. The user scenario may be a user holding the communication device 10 with left hand only, right hand only, both hands, left hand to head, and right hand to head, and so on. For example, the left hand to head scenario refers to the user using the left hand to talk on the phone, and the both hands scenario refers to the user playing games with two hands.

Takes the user scenario detection circuit to be a proximity sensing circuit for example, if a proximity of an object to the antenna ANT_M or ANT_D is detected, the detection signal DET is generated to the control module 12. Then, the control module 12 determines the radiation direction of the antenna ANT_M according to the detection signal DET.

In one embodiment, transmit antenna selection (TAS) is a technique capable of selecting one of multiple antennas as a transmit antenna based on the signal quality of their received signals. For example, the control module 12 determines the transmitting signal TX to be fed to either the antenna ANT_M or the antenna ANT_D according to the detection signal DET or the receiving signals RX_M and RX_D, to select one of the antennas ANT_M and ANT_D with better signal quality to radiate the transmitting signal TX, which ensures the communication quality of the communication device 10.

From another point of view, the antenna ANT_D has a radiation direction toward the up right direction, and the antenna ANT_M has two radiation directions toward the down left and right directions. Equivalently, a transmit antenna for uplink communication of the communication device 10 has three selective radiation directions. Selecting the radiation direction of the antenna ANT_M by impedance tuning of the antenna ANT_M and a feeding channel of the transmitting signal TX, the communication device 10 can adapt to various user scenarios to ensure communication quality and user experience (e.g., data throughput and call-drop rate).

Figure 2:
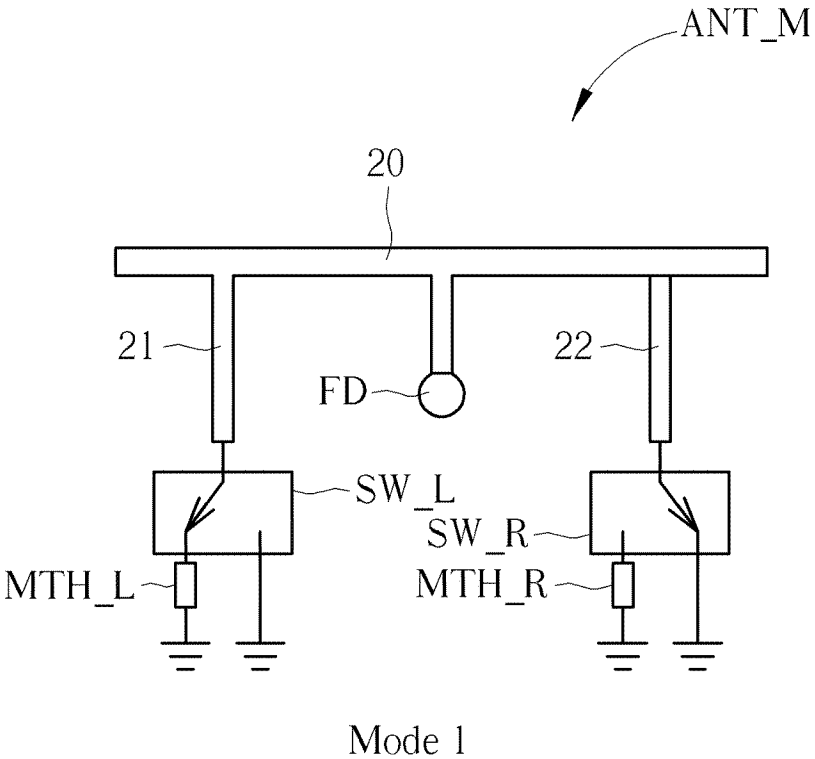
FIG. 2 and FIG. 3 are schematic diagrams of the antenna in FIG. 1 operating in first and second modes according to an embodiment of the present invention, respectively.
Figure 3:
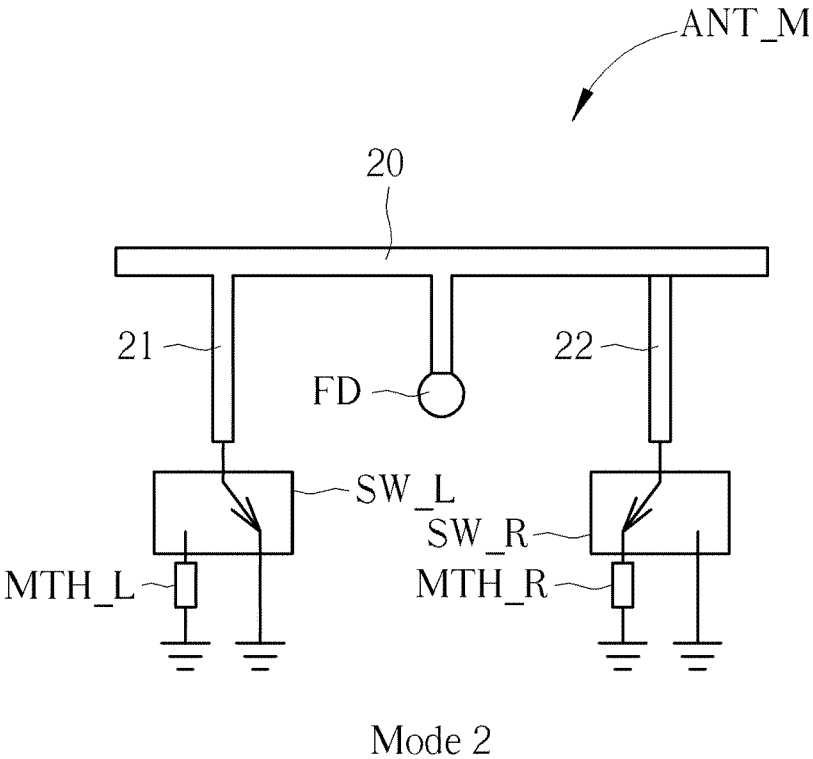

FIG. 2 and FIG. 3 are schematic diagrams of the antenna ANT_M operating in first and second modes according to an embodiment of the present invention, respectively. The antenna ANT_M includes a feed terminal FD, arms 20, 21 and 22, and impedance tuning circuits SW_L and SW_R. The feed terminal FD is used for feeding the transmitting signal TX generated by the control module 12, and transmitting the receiving signal RX_M to the control module 12. The arm 20 is electrically connected to the feed terminal FD for resonating the transmitting signal TX and the receiving signal RX_M to achieve wireless communication. In one embodiment, the arm 20 presents a T-shape. The arm 21 is electrically connected to the arm 20 and the impedance tuning circuit SW_L to be connected with a ground or a matching component MTH_L. The arm 22 is electrically connected to the arm 20 and the impedance tuning circuit SW_R to be connected with the ground or a matching component MTH_R. The feed terminal FD forms loops each with the arms 21 and 22. In one embodiment, the feed terminal FD is between the arms 21 and 22.

In FIG. 2, the antenna ANT_M operates in the first mode, wherein the impedance tuning circuit SW_L connects the arm 21 with the matching component MTH_L, and the impedance tuning circuit SW_R connects the arm 22 with the ground. In such a structure, since the arm 22 at the right portion of the arm 20 is grounded by the impedance tuning circuit SW_R, a radio-frequency (RF) current of the transmitting signal TX flows from the feed terminal FD to the left portion of the arm 20, which makes a radiation direction of the antenna ANT_M direct from the feed terminal toward the arm 21 (i.e., left direction). Therefore, the antenna performance of the antenna ANT_M may be kept within a satisfied level under the circumstance that the human body approaches to the right portion of the arm 20. For example, for a user scenario that a user uses a right hand to hold the communication device 10, the right portion of the arm 20 may be covered by the right palm, and the radiation direction of the antenna ANT_M directs toward the left direction to ensure the antenna performance and the user experience, e.g., call-drop rate and data throughput.

In FIG. 3, the antenna ANT_M operates in the second mode, wherein the impedance tuning circuit SW_R connects the arm 22 with the matching component MTH_R, and the impedance tuning circuit SW_L connects the arm 21 with the ground. In such a structure, since the arm 21 at the left portion of the arm 20 is grounded by the impedance tuning circuit SW_L, the RF current of the transmitting signal TX flows from the feed terminal FD to the right portion of the arm 20, which makes the radiation direction of the antenna ANT_M directs from the feed terminal FD toward the arm 22 (i.e., right direction). Therefore, the antenna performance of the antenna ANT_M may be kept within a satisfied level under the circumstance that the human body approaches to the left portion of the arm 20. For example, for a user scenario that the user uses a left hand to hold the communication device 10, the left portion of the arm 20 may be covered by the left palm, and the radiation direction of the antenna ANT_M directs toward the right direction to ensure the antenna performance and the user experience.

In one embodiment, the matching components MTH_L and MTH_R are used for band tuning, which may be a capacitor, an inductor, a resistor, a bead, a varactor, a tuning capacitor, and any feasible combination of at least two of the capacitor, inductor, resistor, and bead. By properly selecting electric characters and values of the capacitor, inductor, resistor, and bead, desirable operating frequencies and bands of the antenna ANT_M may be obtained. Noticeably, band tuning of the antenna ANT_M is simultaneously performed when selecting the radiation direction since the impedance tuning circuits SW_L and SW_R connect one of the arms 21 and 22 to the ground and connect another one to the matching component.

Figure 4:
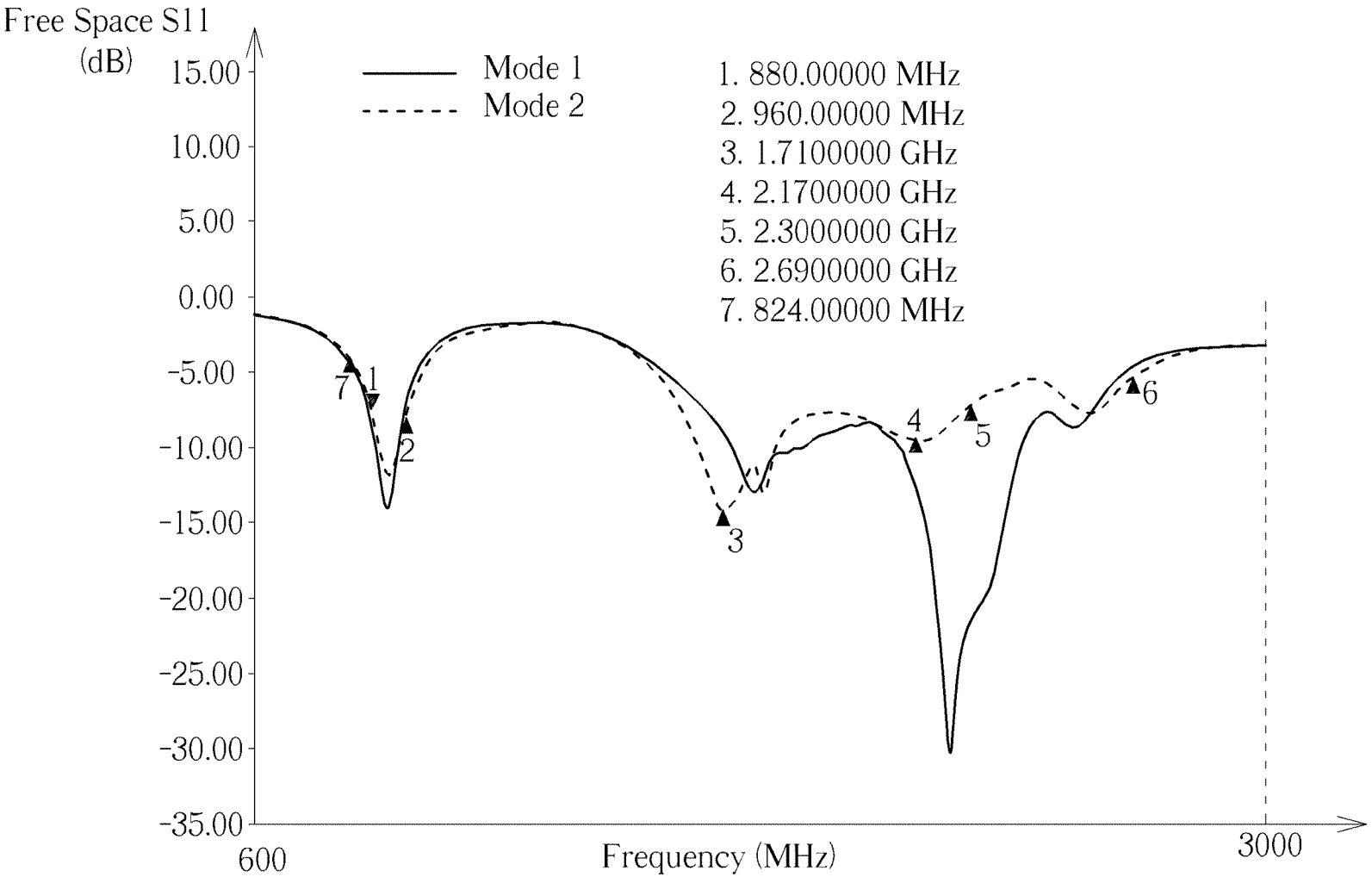
FIG. 4 illustrates the scattering parameter S11 of the antenna in FIG. 1 operating in the first and second modes in free space.
Figure 5:
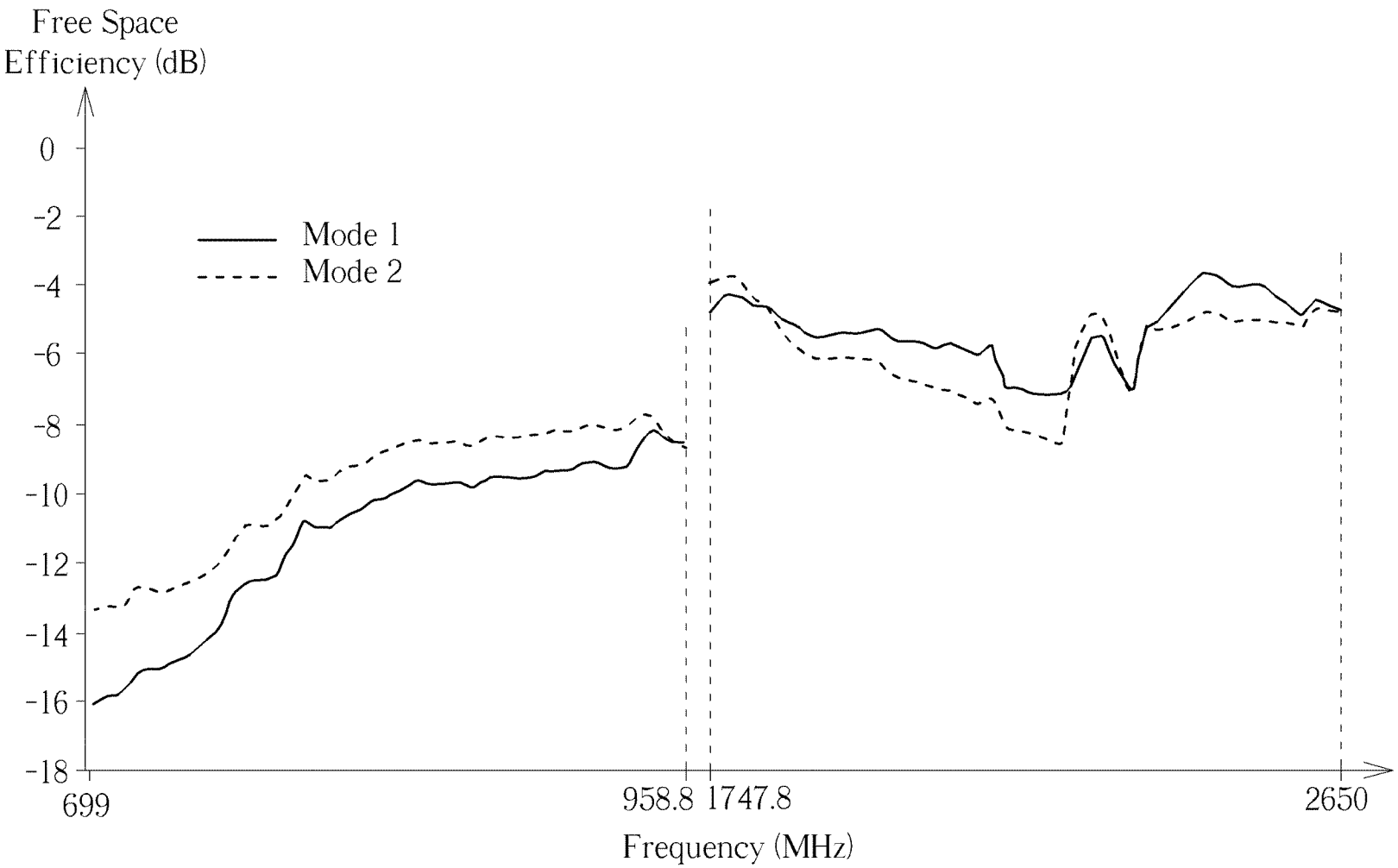
FIG. 5 illustrates the antenna efficiency of the antenna in FIG. 1 operating in the first and second modes in free space.
Figure 6:
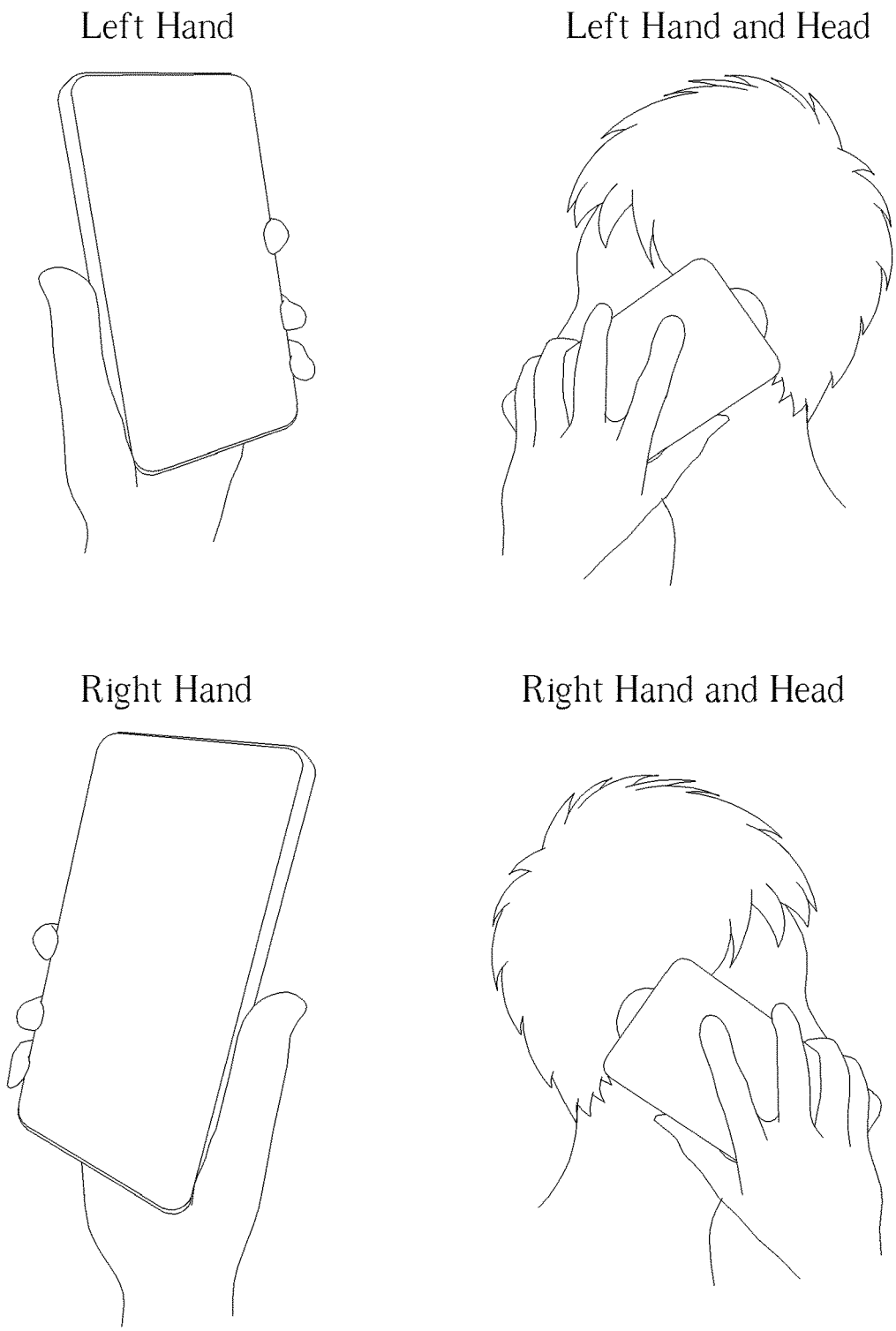
FIG. 6 illustrates various user scenarios when the user holding the communication device in FIG. 1 with left hand only, right hand only, left hand to head, and right hand to head.
Figure 7:
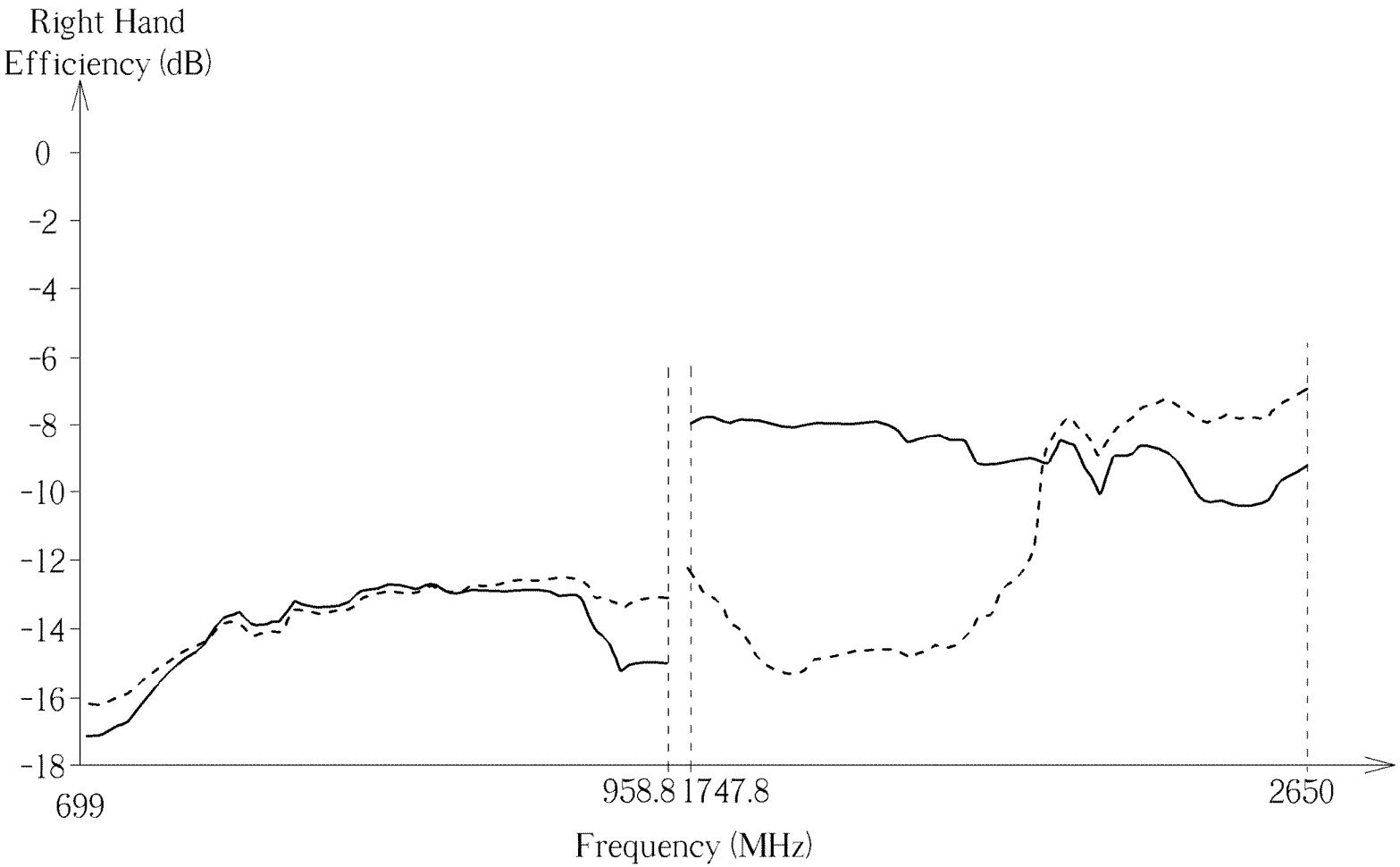
FIG. 7 illustrates the antenna efficiency of the antenna in FIG. 1 operating in the first and second modes in the left hand only user scenario.
Figure 8:
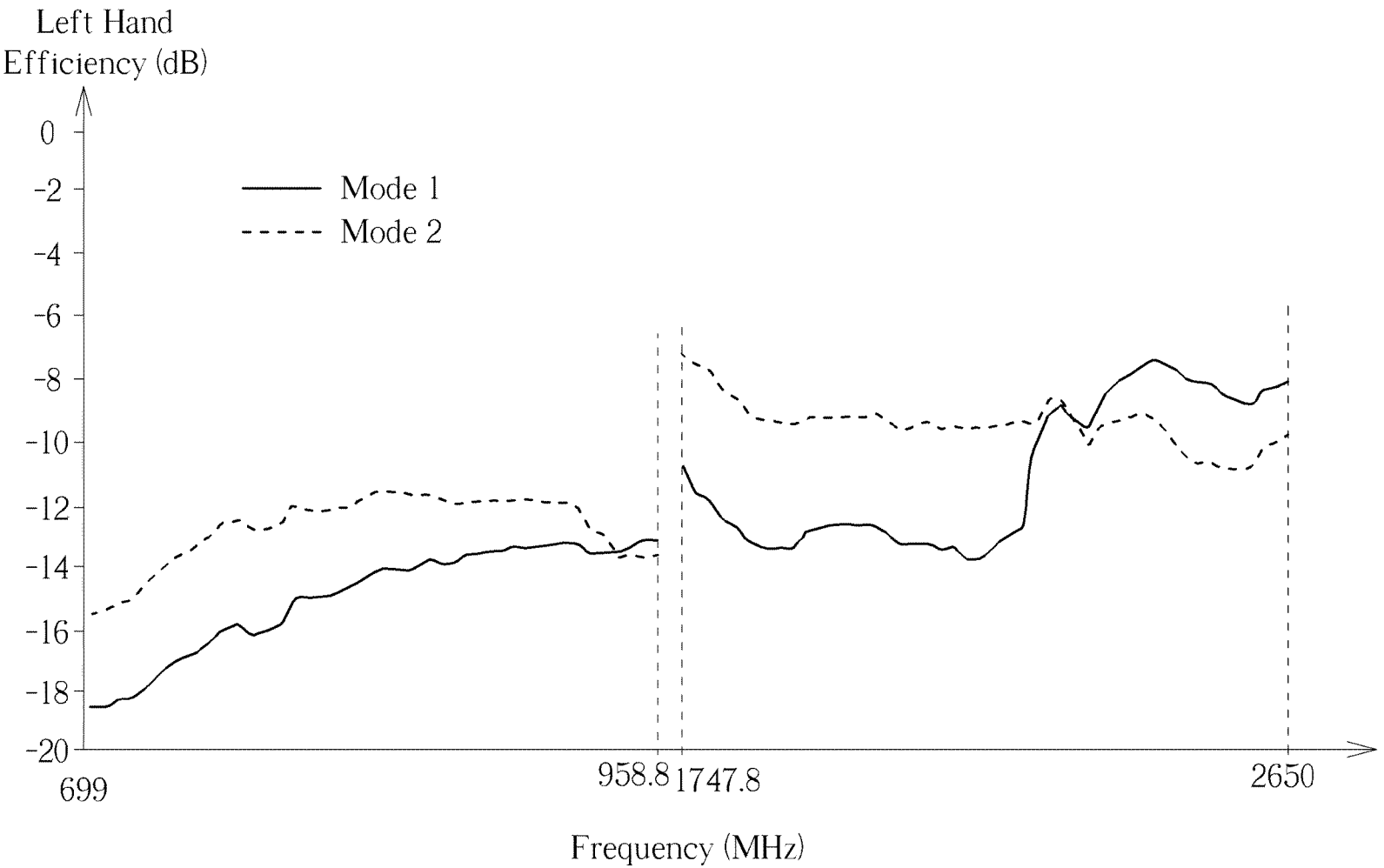
FIG. 8 illustrates the antenna efficiency of the antenna operating in the first and second modes in the right hand user scenario.

FIG. 4 illustrates the scattering parameter S11 of the antenna ANT_M operating in the first and second modes in free space. FIG. 5 illustrates the antenna efficiency of the antenna ANT_M operating in the first and second modes in free space. In FIG. 4, the scattering parameter S11 of the antenna ANT_M operating in the first and second modes are denoted with a solid line and a dash line. In FIG. 5, the antenna efficiency of the antenna ANT_M operating in the first and second modes are denoted with a solid line and a dash line. For long term evolution (LTE) communication standard, a low operating frequency band ranges from 824 to 960 MHz, a middle operating frequency band ranges from 1710 to 2170 MHz, and a high operating frequency band ranges from 2300 to 2690 MHz FIG. 6 illustrates various user scenarios when the user holding the communication device 10 with left hand only, right hand only, left hand to head, and right hand to head. FIG. 7 illustrates the antenna efficiency of the antenna ANT_M operating in the first and second modes in the left hand only user scenario. FIG. 8 illustrates the antenna efficiency of the antenna ANT_M operating in the first and second modes in the right hand user scenario.

In FIG. 7 and FIG. 8, the antenna efficiency of the antenna ANT_M operating in the first and second modes are denoted with a solid line and a dash line, respectively. In FIG. 7, the antenna ANT_M operating in the first mode has the better antenna efficiency in the middle band, and the antenna ANT_M operating in the second mode has the better antenna efficiency in the low and high bands. Therefore, for the left hand only scenario, the radiation direction of the antenna ANT_M is switched to the right direction (second mode) if communication in the low and high bands is required, and radiation direction of the antenna ANT_M is switched to the left direction (first mode) if communication in the middle band is required.

In FIG. 8, the antenna ANT_M operating in the first mode has the better antenna efficiency in the low and high bands, and the antenna ANT_M operating in the second mode has the better antenna efficiency in the middle band. Therefore, for the right hand only scenario, the radiation direction of the antenna ANT_M is switched to the left direction (first mode) if communication in the low and high bands is required, and radiation direction of the antenna ANT_M is switched to the right direction (second mode) if communication in the middle band is required.

Figure 9:
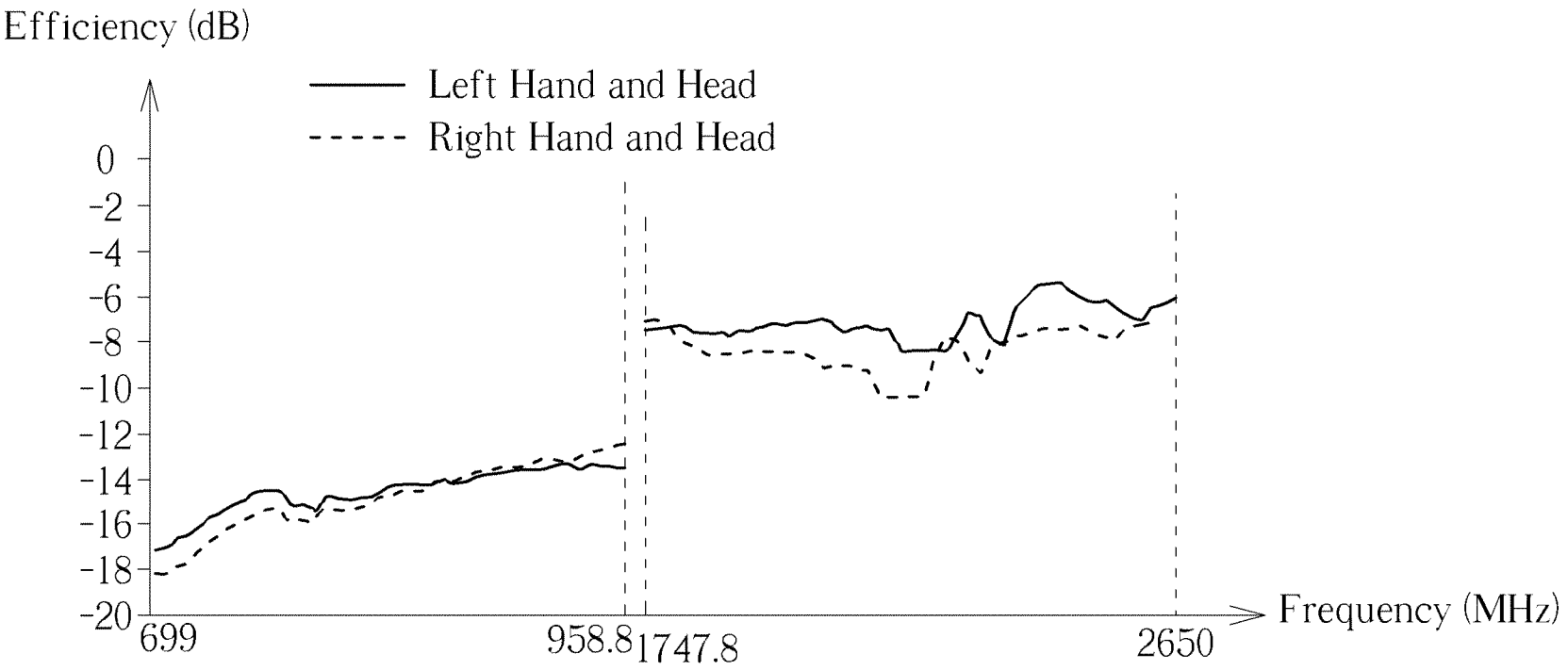
FIG. 9 illustrates the optimized antenna efficiency of the antenna in FIG. 1 in the left hand and head user scenario and right hand and head user scenario.

FIG. 9 illustrates the optimized antenna efficiency of the antenna ANT_M in the left hand and head user scenario and right hand and head user scenario, which is denoted with a solid line and a dash line, respectively. For different operating bands, the communication device 10 selects the radiation direction with the highest antenna efficiency to perform communication, which ensures the communication quality of the communication device 10.

To sum up, the present invention selects the radiation direction of a first antenna by impedance tuning of the first antenna to operate in two operating modes, and the band tuning to the first antenna is simultaneously performed. The first antenna has two operating modes without additional antennas to the communication device, which effectively save the antenna space of the communication device. Further, selecting the radiation direction of the first antenna by impedance tuning and a feeding channel of the transmitting signal to either the first or second antenna of the communication device, the communication device can adapt to various user scenarios to ensure communication quality and user experience (e.g., data throughput and call-drop rate).

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna with swappable radiation direction for a communication device, comprising:

a feed terminal for feeding a transmitting signal and receiving a receiving signal;

a first arm electrically connected to the feed terminal;

a second arm electrically connected to the first arm;

a third arm electrically connected to the first arm, wherein the feed terminal forms loops each with the second arm and third arm;

a first impedance tuning circuit coupled to the second arm for connecting the second arm to a first and a third matching components according to a control signal; and a second impedance tuning circuit coupled to the third arm for connecting the third arm to a second or a fourth matching components according to the control signal;

wherein when the antenna operates in a first mode, the first impedance tuning circuit connects the second arm to the first matching component and the second impedance tuning circuit connects the third arm to the second matching component, and when the antenna operates in a second mode, the first impedance tuning circuit connects the second arm to the third matching component and the second impedance tuning circuit connects the third arm to the fourth matching component.

2. The antenna of claim 1, wherein the first and second impedance tuning circuits are at least one of a switch, a diode, or a tuning capacitor.

3. The antenna of claim 1, wherein the radiation direction of the antenna corresponding to the first mode and second mode is opposite.

4. The antenna of claim 1, wherein the first, second, third and fourth matching components are used for band tuning, and the first, second, third, and fourth matching components are at least one of a capacitor, an inductor, a resistor, a varactor, a tuning capacitor and a bead.

* * * * *